United States Patent [19]

Holder

[11] 4,034,580

[45] July 12, 1977

[54] BOOT SOCK WITH STAY-UP CUFF AND METHOD

[75] Inventor: Otis W. Holder, Mount Airy, N.C.

[73] Assignee: Oakdale Knitting Company, Mount Airy, N.C.

[21] Appl. No.: 740,801

[22] Filed: Nov. 11, 1976

[51] Int. Cl.[2] ..... D04B 9/54

[52] U.S. Cl. ..... 66/172 E; 2/239; 66/173

[58] Field of Search ..... 2/239, 240, 241; 66/173, 171, 172 E

[56] References Cited

U.S. PATENT DOCUMENTS

| | | | |
|---|---|---|---|
| 1,045,620 | 11/1912 | Scott | 66/173 |
| 1,480,381 | 1/1924 | Feig | 2/239 |
| 1,674,627 | 6/1928 | Allen | 66/173 |
| 2,339,963 | 1/1944 | Pierre et al. | 66/173 |
| 3,611,755 | 10/1971 | Millar | 66/173 |

*Primary Examiner*—H. Hampton Hunter

*Attorney, Agent, or Firm*—Bell, Seltzer, Park & Gibson

[57] ABSTRACT

This sock is characterized by a stayup cuff including an outwardly turned welt intergrally knit with the top of the leg of the sock and a single-ply edge portion having an upper edge integrally knit with the lower edge of the outwardly turned welt and with the top of the leg portion of the sock. The single-ply edge portion is adapted to extend down over the covers the upper edge of the boot to aid in preventing the sock from being drawn down into the boot and to aid in preventing the entry of dirt, snow and the like into the boot. The outwardly turned welt extending upwardly above the single-ply edge portion snugly engages the leg of the wearer and aids in preventing the entry of dirt, snow and the like inside of the upper edge of the sock.

13 Claims, 5 Drawing Figures

BOOT SOCK WITH STAY-UP CUFF AND METHOD

This invention relates generally to a boot sock and method of knitting the same and more particularly to a special type of stay-up cuff which resists being drawn down into the boot during wear and which "seals" the area between the leg of the wearer and the upper end of the boot to aid in preventing the entry of dirt, snow, cold air and the like.

Boot socks of the type currently produced are normally provided with a substantially straight upper cuff portion and it is the general practice for the wearer to turn the straight cuff portion down over a portion of the upper end of the boot. However, this type of boot sock offers substantially no protection against the entry of dirt, snow and the like between the leg of the wearer and the upper end of the sock. Also, this type of sock can be easily drawn down into the boot during wear.

It is an object of the present invention to provide a boot sock and method of knitting the same which includes a special type of stay-up cuff including an integrally knit outwardly turned welt extending upwardly above the upper edge of the boot and in snug engagement with the leg of the wearer and a single-ply edge portion integrally knit at its upper end with the lower edge of the outwardly turned welt and adapted to extend down over and cover the upper edge of the boot to aid in preventing the sock from being drawn into the boot and to effectively seal the space between the leg of the wearer and the upper edge of the boot to prevent the entry of foreign matter and the like.

In accordance with the present invention, the outwardly turned welt is knit with a lesser number of wales than the number of wales in the leg and foot portions of the sock and the single-ply edge portion is knit with the same number of wales as the leg and foot portions to provide a course gauge outwardly turned welt which extends upwardly above the top of the leg of the sock and snugly engages the leg of the wearer. The wales of the outwardly turned welt preferably correspond with every other wale of the leg portion and the single-ply edge portion. Elastic yarn is preferably incorporated in the single-ply selvage edge portion to cause it to roll inwardly upon itself and to be maintained in the inwardly rolled condition. An elastic yarn is also preferably incorporated in the upper portion of the leg portion adjacent the outwardly turned welt to provide a lower cuff for drawing the leg portion inwardly to provide a snug fit around the leg of the wearer.

Other objects and advantages will appear as the description proceeds when taken in connection with the accompanying drawings, in which.

Figure 4:
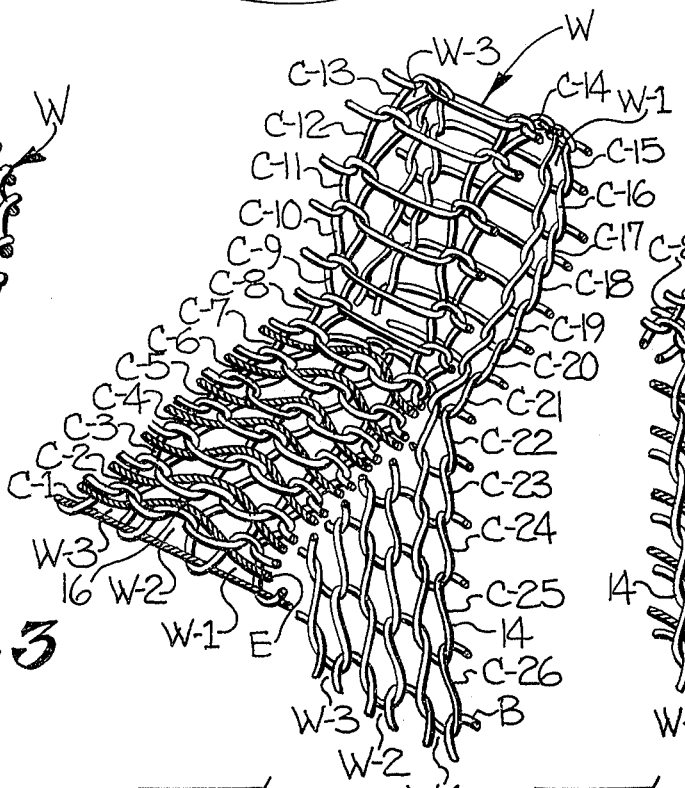
Figure 5:
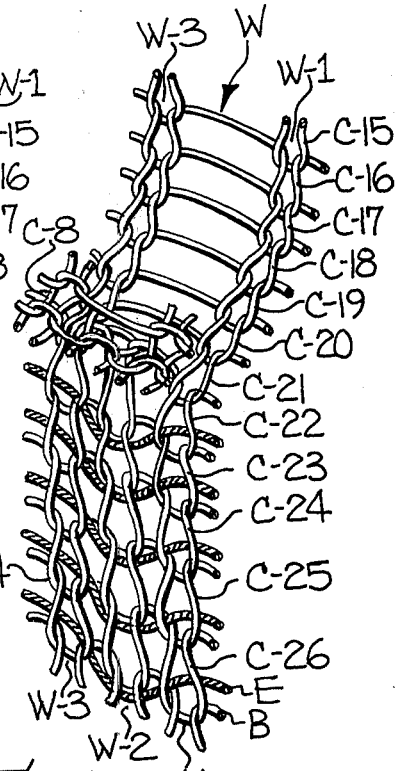

FIG. 4 is a greatly enlarged fragmentary isometric view of a portion of the upper edge of the sock with the single-ply edge portion being illustrated in straight condition and illustrating the manner in which it is joined to the outwardly turned welt and the top of the leg of the sock; and FIG. 5 is a view similar to FIG. 4 but showing the single-ply edge portion and the outer ply of the outwardly turned welt portion being broken away to more clearly illustrate the manner in which the parts are integrally knit.

Although the sock of the present invention is illustrated in use with a "low-cut" type of boot, it is to be understood that the length of the leg portion of the sock may be varied as desired so that the sock may be worn with boots which extend higher up on the leg of the wearer. Also, the sock of the present invention may be easily adapted for use with other types of articles of footwear by simply varying the length of the leg portion so that the stay-up cuff extends substantially coterminous with the upper portion of the article of footwear. The stay-up cuff will still act to resist drawing of the sock down into the article of footwear and also act as a seal between the top of the article of footwear and the wearer's leg.

The sock of the present invention includes a foot portion 10 including any conventional type of toe 11 and heel 12 with an integrally knit and upwardly extending leg portion 13. The foot 10 and leg portion 13 are knit of a body yarn, indicated at B in FIGS. 4 and 5, forming successive courses knit with a predetermined number of wales therein. Portions of a few courses at the upper end of the leg 13 are illustrated in courses C-22 through C-26 of FIGS. 4 and 5. If desired, the upper portion of the leg 13 may have an elastic yarn incorporated with the body yarn stitch loops in any conventional manner to form a lower cuff portion 14. As illustrated in FIG. 5, the elastic yarn, indicated at E, is inlaid in the courses of body yarn stitch loops in a 1 × 1 manner to draw the lower cuff portion 14 inwardly against the leg of the wearer.

Figure 1:
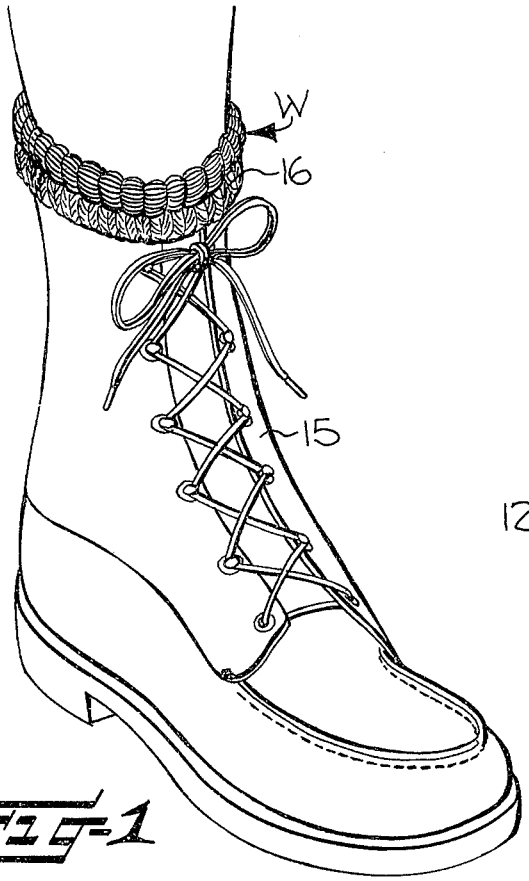
FIG. 1 is a perspective view of a boot with the stay-up cuff of the sock of the present invention extending outwardly from the top edge thereof and showing the single-ply edge portion extending down over and covering the upper edge of the boot.

The stay-up upper cuff of the sock includes an integrally knit outwardly turned welt, broadly indicated at W, including courses knit of the body yarn B with a lesser number of wales than the number of wales in the foot 10 and leg 13. As illustrated in FIGS. 4 and 5, the outwardly turned welt (courses C-9 through C-21) includes courses with knit stitch loops in every other wale to provide fairly long floats of body yarn extending between the needle wales so that the welt W is of a course gauge, as compared to the foot 10 and leg 13. The welt W thus forms what may be termed a "soft roll" which extends upwardly above the upper edge of the article of footwear, such as the boot indicated at 15 in FIG. 1, and snugly engages the leg of the wearer.

The stay-up cuff of the sock of the present invention also includes a single-ply edge portion 16 which has an upper edge integrally knit with the lower edge of the outwardly turned welt W and with the upper edge of the cuff portion 14 of the leg 13. The single-ply edge portion 16 determinates in a non-ravel lower selvage edge (course C-1 of FIG. 4). The single-ply edge portion is illustrated in a substantially straight condition in FIG. 4 but normally assumes the inwardly rolled condition shown in FIG. 3 when an elastic yarn E is incorporated in the courses thereof, as by inlaying in the manner illustrated in FIG. 4. The single-ply edge portion 16, illustrated in courses C-1 through C-8 of FIG. 4, includes courses knit of the body yarn B with the same number of wales as the leg 13 and extends down over and covers the upper edge of the boot 15 to aid in preventing the sock from being drawn down into the boot. The elastic yarn E incorporated in the single-ply edge portion 16 causes it to roll inwardly upon itself and aids in maintaining this inwardly rolled condition so that the single-ply edge portion 16 is maintained in engagement with the upper edge portion of the boot 15.

METHOD OF KNITTING

The sock of the present invention is preferably knit on a conventional type of circular hosiery knitting machine and is knit from the top to the toe. A conventional type of make-up is formed by initially feeding the elastic yarn E to alternate needless. The body yarn B is then fed to all of the needles and all of the needles pass through the stitch cams in active position so that the body yarn B is looped over the elastic yarn E in the formation of course C-1 (FIG. 4). With continued rotation of the needle cylinder, the body yarn B forms successive courses with stitch loops in each needle wale (wales W-1, W-2 and W-3) while the elastic yarn E is inlaid in each course until the knitting of the single-ply edge portion 16 is completed with the knitting of course C-8.

The knitting of the outwardly turned welt W then begins with the knitting of the course C-9 and the feeding of the elastic yarn E is discontinued. The course C-9 is knit with a lesser number of wales than the number of wales knit in the single-ply selvage edge portion 16 and, as illustrated in FIGS. 4 and 5, the outwardly turned welt W is knit with stitch loops in every other wale. With the knitting of the course C-9, alternate needles, including the needle knitting the wale W-2, are maintained in a lowered or inactive position and hold the stitch loops formed in the course C-8 while turned welt W is knit on the remaining needles, including those needles knitting wales W-1 and W-3. Thus, the body yarn B forms relatively long and loose floats extending across the needle wale W-2 to provide a soft roll type of outwardly turned welt W.

Figure 2:
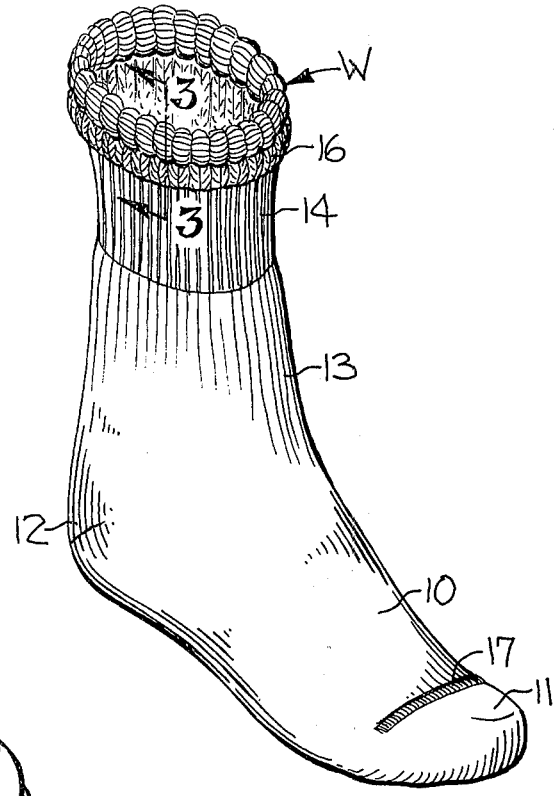
FIG. 2 is a perspective view of the sock of the present invention in the position it assumes when worn.

Upon the completion of the knitting of the desired number of courses to form the outwardly turned welt W, with the completion of the knitting of course C-21 in FIGS. 4 and 5, the body yarn B is again fed to all of the needles to form stitch loops in every wale, as illustrated in course C-22 of FIG. 5. When a stitch loop is formed in wale W-2 of course C-22, it is drawn through the stitch loop which has been held on the inactive needle during the knitting of the outwardly turned welt W. Thus, upon the completion of the knitting of the course C-21, the upper edge portion of the single-ply edge portion 16 is integrally knit with the lower edge of the outwardly turned welt W and with the upper edge of the lower cuff 14 of the leg 13. The feeding of the elastic yarn E is again continued so that it is incorporated in the courses C-22 through C-26 of the lower cuff 14 of the leg 13. After the desired length of the lower cuff 14 is knit, the feeding of the elastic yarn E is discontinued and the leg portion 13 is knit by continuing to feed the body yarn B and forming stitch loops on all of the needles. The foot portion 10 is then knit in a conventional manner and the sock is removed from the knitting machine with the usual toe opening formed therein. The toe opening may be closed by any suitable means, such as by seaming along a line 17 (FIG. 2).

Figure 3:
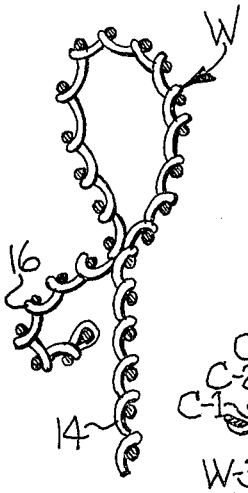
FIG. 3 is an enlarged vertical sectional view taken substantially along the line 3—3 in FIG. 2.

As illustrated in FIG. 3, the elastic yarn E incorporated in the courses of the single-ply edge portion 16 causes this portion to roll inwardly upon itself and aids in maintaining it in this inwardly rolled condition when it covers the upper edge of the boot. Thus, the sock of the present invention includes a special type of stay-up cuff which resists being drawn down into the boot during wear and which seals the area between the leg of the wearer and the upper edge of the boot to prevent entry of foreign matter, such as dirt, snow, cold air and the like, when the sock is being worn. The single-ply edge portion extending down over and covering the upper edge of the article of footwear aids in resisting the drawing down of the sock and also prevents the entry of dirt, snow and the like between the sock and the upper edge of the boot. The soft roll turned welt W snugly engages the leg of the wearer and prevents the entry of dirt, snow and the like between the sock and the leg of the wearer and also provides a pleasing ornamental appearance around the upper edge of the sock.

In the drawings and specification there has been set forth a preferred embodiment of the invention, and although specific terms are employed, they are used in a generic and descriptive sense only and not for purposes of limitation, the scope of the invention being defined and the claims.

That which is claimed is:

1. A sock including leg and foot portions comprising courses knit of a body yarn with a predetermined number of wales therein, and a stay-up cuff comprising an integrally knit outwardly turned welt including courses knit of the body yarn with a lesser number of wales than the number of wales in said leg and foot portions, said lesser number of wales in said outwardly turned welt being joined to selected wales only of the top of said leg portion, and a single-ply edge portion including courses knit of the body yarn with the same number of wales as said leg and foot portions, said single-ply edge portion being integrally knit with the lower edge of said outwardly turned welt and with the top of said leg portion and terminating in a non-ravel lower selvage edge, and turned welt being adapted to extend upwardly above the upper portion of an article of footwear with which said sock is to be worn to aid in preventing the entry of foreign matter and the like into the sock, and said single-ply edge portion being adapted to extend downover and cover the upper edge of the article of footwear to aid in preventing the sock from being drawn down into the article of footwear and the entry of foreign matter and the like into the article of footwear.

2. A sock according to claim 1 wherein said integrally knit outwardly turned welt includes a wale corresponding with every other wale of said leg portion.

3. A sock according to claim 1 including elastic yarn incorporated in selected courses in said single-ply edge portion, said elastic yarn causing said single-ply edge portion to roll inwardly upon itself and to be maintained in the inwardly rolled condition.

4. A boot sock including leg and foot portions comprising courses knit of a body yarn with a predetermined number of wales therein, and a stay-up cuff comprising an integrally knit outwardly turned welt including courses knit of the body yarn with a wale corresponding with every other wale of said leg portion, the wales in said outwardly turned welt being joined to every other wale only of the top of said leg portion, said turned welt being adapted to extend upwardly above the upper portion of the boot with which said sock is to be worn, and a single-ply edge portion including courses knit of the body yarn with the same number of wales as said leg portion, said single-ply edge portion being integrally knit with the lower edge of said outwardly turned welt and with the top of said leg portion and terminating in a non-ravel lower selvage edge, elastic yarn incorporated in selected courses in said single-ply edge portion to cause the same to roll inwardly upon itself and to be maintained in the inwardly rolled condition, said inwardly rolled single-ply edge portion being adapted to extend down over and cover the upper edge of the boot to aid in preventing the sock from being drawn into the boot and the entry of foreign matter and the like into the boot.

5. A sock according to claim 4 wherein said elastic yarn is incorporated in said single-ply edge portion by inlaying.

6. A sock according to claim 4 including an elastic yarn incorporated in the courses of said leg portion adjacent said outwardly turned welt for drawing said upper portion of said leg portion inwardly against the leg of the wearer.

7. A sock according to claim 6 wherein said elastic yarn in incorporated in the courses of said upper portion of said leg portion by inlaying.

8. A sock including foot, leg and lower cuff portions comprising courses knit of a body yarn with a predetermined number of wales therein, said lower cuff including elastic yarn incorporated therein to maintain said lower cuff in snug engagement with the leg of the wearer, and an upper stay-up cuff comprising an integrally knit outwardly turned welt including courses knit of the body yarn with a lesser number of wales than the number of wales in said leg and foot portions, said lesser number of wales in said outwardly turned welt being joined to selected wales only of the top of said leg portion, and a single-ply edge portion including courses knit of the body yarn with the same number of wales as said leg and foot portions, said single-ply edge portion being integrally knit with the lower edge of said outwardly turned welt and with the top of said leg portion and terminating in a non-ravel lower selvage edge, said turned welt being adapted to extend upwardly above the upper portion of an article of footwear with which said sock is to be worn to aid in preventing the entry of foreign matter and the like into the sock, and said single-ply edge portion being adapted to extend down over and cover the upper edge of the article of footwear to aid in preventing the sock from being drawn down into the article of footwear and the entry of foreign matter and the like into the article of footwear.

9. A method of knitting a sock including leg and foot portions comprising courses knit of a body yarn with a predetermined number of wales therein, and a stay-up cuff adapted to extend substantially coterminous with the upper portion of an article of footwear with which said sock is to be worn, said method comprising the steps of knitting a non-ravel selvage edge and a plurality of courses of a body yarn with a predetermined number of wales to form a single-ply edge portion, holding stitch loops in selected wales of the final course of said single-ply edge portion while forming a plurality of courses of stitch loops in the remaining wales to form a welt portion, knitting a single course while forming stitch loops in said predetermined number of wales to join opposed ends of said welt portion and to form an outwardly turned welt with the lower ends of said turned welt being integrally knit with said single-ply edge portion and said single course, and continuing to knit courses with the body yarn with stitch loops in said predetermoned number of wales to complete the knitting of the leg and foot portions of said sock.

10. A method according to claim 9 wherein stitch loops in every other wale of the final course of said single-ply edge portion are held during the knitting of said welt portion.

11. A method according to claim 9 including the step of incorporating an elastic yarn in said single-ply edge portion.

12. A method according to claim 9 including the step of incorporating an elastic yarn in the courses of said leg portion adjacent said turned welt.

13. A method according to claim 9 including the steps of incorporating an elastic yarn in said single-ply edge portion, and incorporating an elastic yarn in the courses of said leg portion adjacent said turned welt.

* * * * *